United States Patent [19]

Kirkland, Jr.

[11] 4,040,486

[45] Aug. 9, 1977

[54] METHOD AND APPARATUS FOR AIR DEVELOPMENT AND REJUVENATION OF WATER WELLS

[75] Inventor: Joe D. Kirkland, Jr., Amarillo, Tex.

[73] Assignee: Steve Taylor, Amarillo, Tex. ; a part interest

[21] Appl. No.: 685,081

[22] Filed: May 10, 1976

[51] Int. Cl.[2] ..... E21B 37/00; E21B 43/00; E21B 43/25

[52] U.S. Cl. ..... 166/311; 166/68; 166/222; 166/314

[58] Field of Search ..... 166/311, 312, 222, 223, 166/314, 68, 112

[56] References Cited

U.S. PATENT DOCUMENTS

| | | | |
|---|---|---|---|
| 2,768,694 | 10/1956 | Moll et al. | 166/312 X |
| 3,729,054 | 4/1973 | Yokoyama | 166/312 |
| 3,760,878 | 9/1973 | Peevey | 166/311 X |
| 3,853,176 | 12/1974 | Henrich | 166/223 |

*Primary Examiner*—Stephen J. Novosad
*Attorney, Agent, or Firm*—Wendell Coffee

[57] ABSTRACT

Slugs of high pressure air at pressures of about 2000 psi (150 atmosphere) are jetted against the screen of the casing or well wall in the aquifer of a water well. Fine material washed from the aquifer by this procedure is picked up from the bottom of the well by an airlift pump. The development of a new well will remove the mud cake from the bore and, also, rearrange fines and silt that were in the aquifer before drilling. On old cased wells, the procedure will remove algae and rust from the screen of the casing, rearrange the gravel pack around the screen and, remove silt and fines that have gathered within and around the gravel pack.

25 Claims, 5 Drawing Figures

SOURCE OF AIR UNDER PRESSURE
SOURCE OF GAS UNDER HIGH PRESSURE
20
21
22
24
25
26
18
10
12
16
28
14

26
28
42
34
36
30
32
3
40
5
46
44
4

40
36
30
38
48

30
44

36
30
38

METHOD AND APPARATUS FOR AIR DEVELOPMENT AND REJUVENATION OF WATER WELLS

BACKGROUND OF THE INVENTION

1. Field of the Invention

This invention relates to water wells and more particularly to a process of developing or cleaning a well and rejuvenating a well.

2. Description of the Prior Art

After drilling a water well, some water will flow into the well from the aquifer (the water bearing formation or strata). If the aquifer is sandy so that the sand of the formation tends to flow into the well, it is necessary to place casing in the well to hold back the sand of the aquifer. The casing at the aquifer is formed into a screen by slitting the casing with narrow slits. If the slits are made wide, the sand itself will flow into the casing, defeating the purpose of the casing. Therefore, often the slits in the casing at the screen are quite narrow and the slits themselves will only be for one to five per cent of the total area of the casing. Often after the casing is placed in the well and before water production or development of the well, the well is gravel packed, i.e., a filter bed of gravel is placed between the casing and the well bore.

After the well is cased and gravel packed, the well is developed. As used herein, the word "developed" means the process performed on a new well by which the mud cake formed by drilling is removed and fines and silt within the aquifer are washed from the aquifer to increase the water flow into the casing.

Pumping water from the well itself is one type of development. With the pumping of the water, certain of the fines and silt will flow from the aquifer whether or not the well is gravel packed. Also, of course, a sufficient flow of water will even bring some of the mud cake from the walls. Accompanied by pumping the well, the well may be backwashed, which is to say that water is pumped from the well and then the ceased and the water in the eduction tube is permitted to gush back into the well, causing a certain amount of agitation which stirs up the fine material to be removed from the well. Because of the sand removed, development by pumping and backwashing caused wear on the pump.

Another type of development is high-speed bailing. By these procedures, a bailer or bucket on a cable is lowered to the bottom of the well and reeled upward at high speed. The movement of the bailer within the casing will cause a high pressure above the bailer and a low pressure or vacuum below the bailer. This, itself, will agitate the material around the well to remove undesired material therefrom.

In addition to the above, it has been suggested that one could develop a well by high velocity water jets. Specifically, "Ground Water and Wells," First Edition 1966, published by Edward E. Johnson, Inc., St. Paul, Minn. Page 309 thereof states that the water may be jetted against the screen at a velocity of 190 feet per second and a pressure of 250 psi and having a discharge 104 gallons per minute. On Page 389, "Ground Water and Wells," it is stated that it is desirable to use an air lift accompanying the jetting.

Also, "Water Well Manual," by V. P. Gibson and R. D. Singer, Premier Press, Berkely, California, 1969, 3rd printing 1973, beginning on Page 101, describes such a high velocity jetting. They described the process using water at 100 psi and 10 gallons per minute per each 3/16th inch nozzle used in jetting water. It is also suggested in "Water Well Manual" to accompany the action with pumping the well.

E. W. Denison in "Ground Water—Its Development, Use and Conservation," published by Edward E. Johnson, Inc., St. Paul, Minn., First Edition 1947, at Page 237, describes what is called "Air Development of Wells." In it an air lift or pump is used. I.e., an air pressure hose is lowered into the well and the end of the hose is within the bottom of the eduction tube. Of course, it is recognized that if as much as 30% of the eduction tube from the bottom of the well to the top of the ground is standing under water, putting air into the eduction tube at the bottom will cause water to flow to the top. Then, a regular flow of air will cause the well to pump. However, if the air valve is opened wide, there will be a surge of air which will blow out from the eduction tube and around the screen and into the formation. This process is described on Page 237 and the desirable pressures to be used are said to be 100 to 150 psi. I can find no reference to using air pressures higher 150 psi.

In "Ground Water and Wells," cited above, the description of air development is found on Page 303 and following pages. Again, the preferred pressures are listed as 100 psi to 150 psi. It is stated that for the expected production of the well there should be ¾ cubic foot of air available for each gallon of water. I.e., if the well was expected to product 100 gallons per minute of water, there should be 75 cubic feet per minute of air available. On Page 304, he gives a specific example that with a well expected to produce 400 to 700 gallons per minute of water, a 10 inch or larger casing would be used and an 8 inch eduction tube would be used and a 2.5 inch air pipe would be used. He indicates for optimum performance, there should be 60% submergence, i.e., 60% of the eduction tube should be below the water level, but the process will still operate with 30% submergence.

In old wells, i.e., wells which have been producing water for five or 10 years or more, often the production is reduced because the openings in the screen of the casing are decreased. The rusting of the casting itself may reduce the openings. Further, the slots may be closed, not only with gravel, but with silt, sand and fine material from extended use. Also, the screen may be clogged with algae. Various procedures have been developed for opening the screen, namely, acid or physically scraping with brushes or scrapers. Another means of cleaning or rejuvenating an old well is to detonate small charges of an explosive at the screen in the casing.

Before filing this patent application, a preliminary search disclosed the following U.S. Pat. Nos.;

Strumpf, 1,360,053; Yarbrough, 1,916,875; Hillger, 2,662,486; Beckett, 3,062,290; Edwards, 3,334,697; Dendy, 3,561,534; Peevey, 3,760,878.

SUMMARY OF THE INVENTION

New and Different Function

I have discovered that blasts or slugs of high pressure air jetted outward against the screen of the casing is an advantageous development and cleaning and rejuvenating technique. As used herein by "high pressure" I mean pressure of at least 1000 psi (75 atmosphere). Most pressures will be given in atmosphereic pressures. Inasmuch as much of the work done on developing this invention was done in the panhandle or southern high plains region of Texas where the elevation is about 3200 feet (960 meters) above sea level, 13.4 psi was taken as the pressure of one atmosphere. However, inasmuch as much of the concern is the volume of the air as well as the pressure, this figure was used in the conversion.

I have found that the blast or the slug of high pressure air jetted against the screen not only cleans the rust and algae from the screen, but also will result in agitation or rearrangement of a gravel pack around the screen so that the smaller particles of gravel as well as sand, silt and debris are removed from the immediate area of the screen and the sand, silt and the like washed from area. Also because of the tremendous volume of air that is injected into the well, this will cause beneficial agitation as much as 100 feet (30 meters) from some wells, meaning that a circular development as much as 200 feet (60 meters) in diameter will occur.

Furthermore, being buoyant after entering the well, the tremendous volume of air will move upward through the formation, continuing to cause agitation and washing to remove the fines and silt toward the well bore where it can be picked up from the bottom of well. The more violent movement in the development is the movement away from the casing. There is a more gentle movement back to the casing. Also, since the movement of the air is upward, I have found it desirable to start at the bottom because the material is moved upward more than in any other direction.

By this technique, I have more than doubled the water producing capabilities of many old wells.

OBJECT OF THE INVENTION

An object of this invention is to produce water from an aquifer.

Another object is to develop a new water well.

Still another object is to clean and rejuvenate an old water well.

Other objects are to achieve the above with a device that is sturdy, compact, durable, lightweight, simple, safe, efficient, versatile, and reliable, yet inexpensive and easy to manufacture, adjust, operate, and maintain.

Further objects are to achieve the above with a method that is versatile, rapid, efficient, and inexpensive, and is easy to adjust, operate, and maintain.

The specific nature of the invention, as well as other objects, uses, and advantages thereof, will clearly appear from the following description and from the accompanying drawing, the different views of which are not to the same scale.

DESCRIPTION OF THE PREFERRED EMBODIMENT

Figure 1:
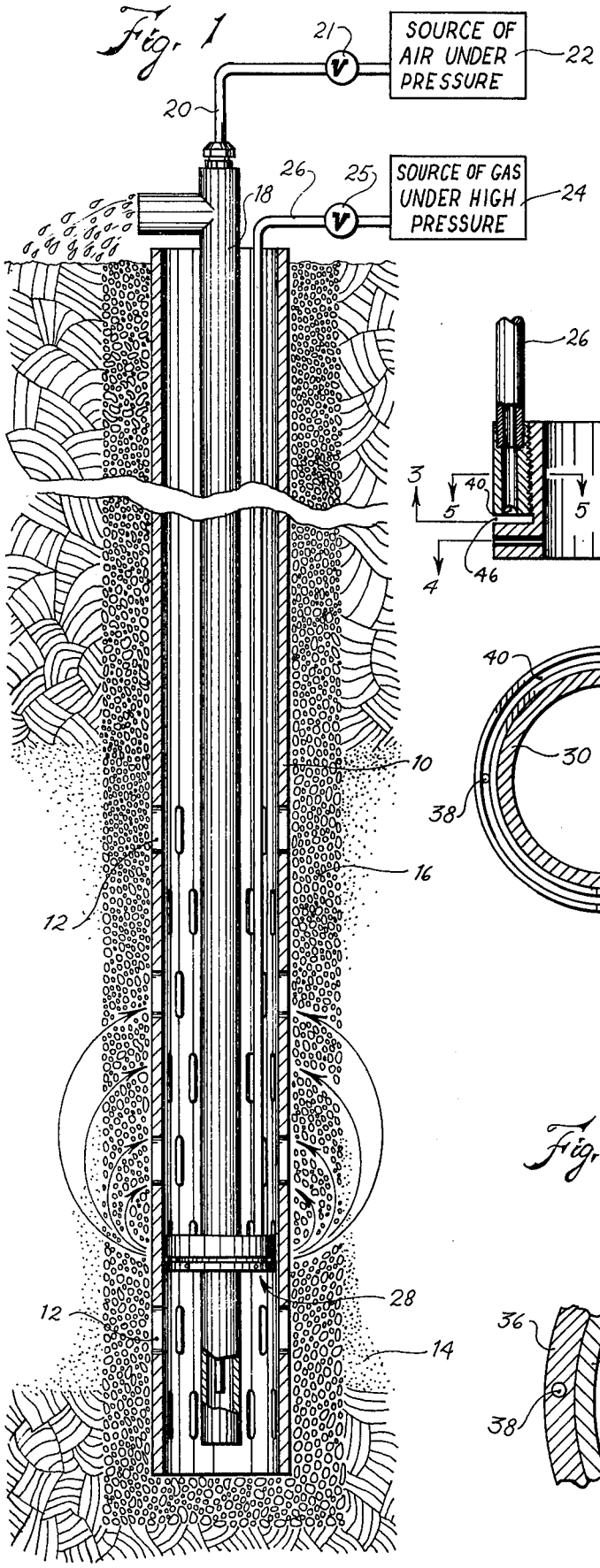
FIG. 1 is a cross sectional representation, foreshortened for clarity and somewhat schematic, showing an embodiment of the equipment used to practice my invention in a cased well.
Figure 2:
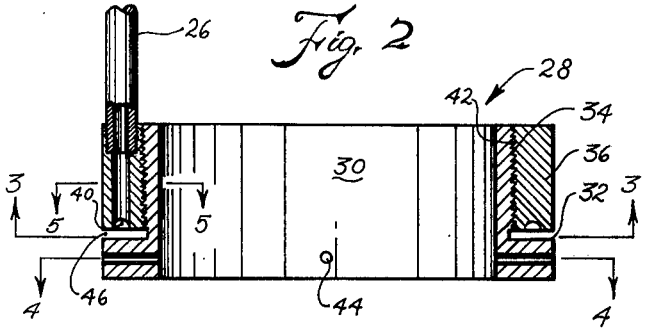
FIG. 2 is an axial sectional view of the ring thereof.
Figure 3:
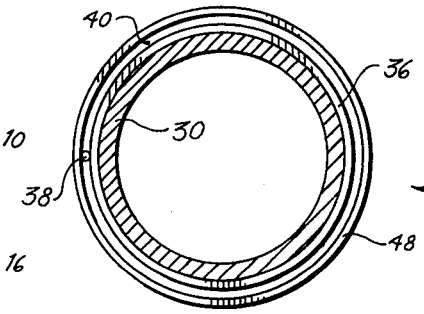
FIG. 3 is a cross sectional view taken substantially on line 3—3 of FIG. 2.
Figure 4:
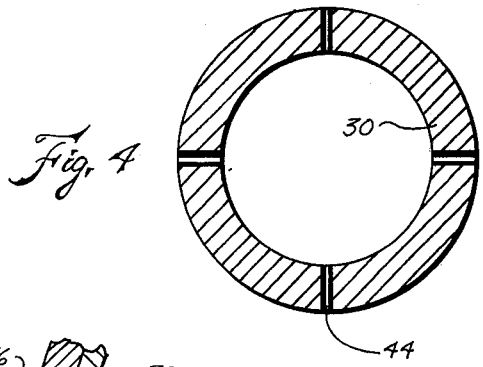
FIG. 4 is another cross sectional view taken substantially on line 4—4 of FIG. 2.
Figure 5:
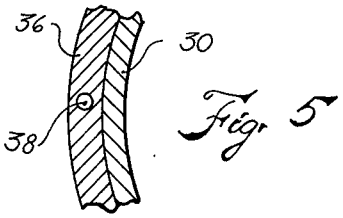
FIG. 5 is a detail taken substantially along one side as shown by line 5—5 of FIG. 2.

Referring more particularly to the drawing, there may be seen in FIG. 1 one embodiment of this invention. There is a bore hole which has therein casing 10. The casing has slots 12 therein, thus forming a screen in that strata having water containing sands 14, which is the aquifer. Around the bore hole there is gravel pack 16. Eduction tube 18 extends in the casing to near the bottom of the well.

Within the eduction tube 18 extends air tube 20. The expulsion of air under normal area conditions lifts the water out. As illustrated, the air tube 20 is connected to a source 22 of air under pressure. It is contemplated for wells with no more than 200 feet (60 meters) submergence that this air under pressure would be under about 10 atmosphere absolute (125 psig). It will be understood that this will produce a flow of water from the bottom of the well.

Also, there is source 24 of air under high pressure by which is meant that air is available at a pressure of at least 75 atmosphere absolute (1000 psig).

A source of air under high pressure 24 is connected by conduit 26 to plenum or jet ring 28. The ring 28 is a means circling the eduction tube for jetting the air out in all horizontal directions.

The procedures followed in operation are the same whether it is to develop a new well or to rejuvenate an old well. The water is commenced flowing from adjacent the bottom of the well by opening valve 21 in the air tube 20 so that it begins picking up water from the bottom of the well. After the ring 28 around the eduction tube 18 is lowered to the bottom of the well, the pressure at the source 24 of air under high pressure is built up to a desirable amount. E.g., the pressure therein is built up to 170 atmosphere absolute (2250 psig) and then quick-opening valve 25 within the conduit 26 is opened so that the pressure within the source drops to 132 atmosphere absolute (1750 psig) in a time of 10 seconds. Then, the valve is closed and the ring 28 is raised three inches (assuming that there is a set of slots 12 each three inches along the casing). With the pressure within the high pressure tank 24 again at 170 atmosphere absolute, the valve in the conduit 26 is again and the pressure is again reduced to 132 atmosphere absolute.

This procedure is continued until water begins to flow at the surface from the annular space between the casing 10 and the eduction tube 18. This is undesirable because it makes undesirable working conditions at the surface of the ground. Therefore, when this beings to occur, the length of time of the opening of the valve is reduced so the pressure drops to a higher value. I.e., I have found that when there is only 60 feet (18 meters) of water above the ring 28, the pressure drop is from 170 atmosphere absolute to about 150 atmosphere absolute (2000 psig) is about the limit of air which may be injected without bouncing water out from the top of the casing.

I have had good success using an air tank upon the surface of the ground having about 0.75 cubic meters (26 cu. ft.) capacity.

In other instances, I have had commercial success with beneficial results, both on new and rejuvenated wells, using an above-surface air tank having 0.3 cubic meter capacity and building the air up to 110 atmosphere pressure and reducing it to 90 atmosphere pressure in a 20 seconds time period for the injection of each slug of air. This was with wells having as much as 100 meters of water standing at the bottom of the well.

I am uncertain as to what happens underground, but it would appear that if the ring 28 were under about 100 meters (300 feet) of water that as the pressure is reduced from 170 atmosphere absolute to 132 atmosphere absolute, about 28 cubic meters of air at atmosphereic pressure, is being released from the ring. At the depth of about 100 meters, the pressure is about 11 atmosphere absolute and, therefore, the volume of air being released from the ring under those pressures would be only about 2.5 $m^3$. This volume of air is a tremendous volume of air being released within the annular space between the eduction tube and the casing, assuming that an 8 inch (20 cm) diameter induction tube was being used and 16 inch (40 cm) diameter casing. Certainly with the nozzle jetting outward, a great amount of the air being released, not only will there be a surge of water out of the slots 12 in the casing 10, but also a large volume of air will be forced through the slots 12 and through the gravel pack 16 and into the aquifer 14 itself. There will be a great surge of water outward and away from the bore hole. Then, as the air moves upward through the aquifer, the pressure becomes less and the volume of air will increase. Assuming that at the top of the aquifer there is still 60 feet (10 meters) of water standing at the top of the aquifer and, therefore, there will be about 3 atmosphere absolute pressure. Then at that point, of course, the volume of air will be about 9.5$m^3$.

Using my procedure, I have drilled an observation well 75 feet (25m) from the casing 10. At 25m distance, each time a slug of air is released into the well there will be a change of water level in the observation well 25 m distance. I have observed changes of 3m in the water level of the observation well. Sometimes air is bubbled from the water in the observation well. Thus, I have concluded that there is a development not only in the immediate vicinity of the well being developed, but there is a development in the washing and flushing of the aquifer for many meters in every direction from the well.

It may be analyzed that if there is 60 feet (18 meters) of water over the ring 28 and the pressure is from at least 170 atmosphere absolute to 150 atmosphere absolute that there would be 15 cubic meters at atmospheric pressure released. Under pressure existing in the well this would be about 5 cubic meters of air released at this pressure. The air is released within a 10 second period and as may be seen there is a tremendous velocity of fluid movement within the bottom of the well.

During all of the development period and during the time the blast of air being injected at the bottom of the well, the airlift pump continues to lift. It is not necessary that the airlift pump produced large volumes of water, but only sufficient volumes to prevent an accumulation of sand and mud in the bottom of the well.

It is contemplated that in the air tanks 22, which are a source of air under pressure and a source 24 of air under high pressure, the air will be compressed by conventional pumps. To date, this is my sole experience. However, there are other ways of obtaining gas under high pressures such as by direct products of explosion. However, I contemplate that if products of direct explosion were used as a source of gas under high pressure that these would be accumulated in storage tanks at the surface of the air and that the explosions would not occur at the bottom of the well.

As stated before, what occurs is made on the basis of rough calculations and supposition. No attempt has been made to calculate for temperature or friction in the pipes, etc. In making this observation, I know the capacity of the air tank above the ground and I know the pressure readings upon the air tank. I can only speculate as to what happens underground and these speculations are aided by observations in the observation well, the sand being mixed with the water from the well and occasionally the overflowing of the well itself between the casing 10 and the eduction tube 18. However, based upon my experience to date, I have reason to believe that the operation would be commercially successful and beneficial if ½ cubic meter (18 cu. ft.) of air at the pressures existing at the point of injection were injected in a 10-second period. This would be an injection rate of 50 liters per second (1.75 cu. ft. per second or 780 gallons per minute). At this point I am of the opinion that if that amount of air were blasted through the screen and into the formation, there would be good development of the formation of a new well or good rejuvenation of an old well.

Referring again to the drawing and specifically the equipment used to perform this and described in detail at the ring 28, there may be seen that the ring has two major components. Metering ring 30 extends for the full height of the ring 28. The metering ring has metering ledge 32 at the bottom. The metering ring 30 has external threads 34 above the metering ledge 32. The other component of the ring 28 is plenum ring 36. The plenum ring 36 extends from the metering ledge 32 to the top of the ring 28. The plenum ring has axial bore or opening 38 which extends from the top to plenum groove 40 in the bottom surface thereof. The plenum ring has internal threads 42 along the entire internal surface thereof. Holes 44 extend through the bottom portion of the metering ring 30 for the use of a spanner wrench to adjust jet gap 46 between the metering ledge 32 and metering lip 48 around the plenum groove 40. The jet gap 46 circumscribes the ring 28. The air conduit 26 is connected as by threading into the top of the bore 38 and, therefore, connects to the plenum groove 40.

Therefore, it may be seen that by the rotation of the metering ring 30, the width of the jet gap 46 between the metering ledge 32 and lip 48 may be adjusted. It will be noted that the ring 28 has an outside diameter only slightly smaller than the inside diameter of the casing 10. I have had good success with only 3mm (⅛ in.) clearance between the ring 28 and the casing 10, specifically using a casing 40cm inside diameter and a ring 28 of about 39cm outside diameter. Therefore, it may be seen that the slug of air is jetted out at high velocity from the gap 46 in all directions horizontally. Also it will be recognized that with a very small spacing between the casing and the ring, a large portion of the air will go directly through the slots 12 in the casing 10.

As an aid to correlating the terms of the claims to the exemplary drawing, the following catalog of elements is provided:

| | | | |
|---|---|---|---|
| 10 | casing | 28 | ring |
| 12 | slots | 30 | metering ring |
| 14 | aquifer | 32 | metering ledge |
| 16 | gravel pack | 34 | threads |
| 18 | education | 36 | plenum ring |
| 20 | air tube | 38 | bore |
| 21 | valve | 40 | plenum groove |
| 22 | air source | 42 | internal threads |
| 24 | air under high pressure | 44 | spanner wrench holes |
| 25 | valve | 46 | gap |
| 26 | conduit | 48 | metering lip |

The embodiment shown and described above is onl exemplary. I do not claim to have invented all the parts elements or steps described. Various modifications ca be made in the construction, material, arrangement, an operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. The method of developing a water well having an eduction tube comprising: periodically jetting slugs of high velocity air from within the well outward in all horizontal directions, and while jetting air also continuously producing enough water from the bottom of the well by the eduction tube to remove all silt and debris therefrom.

2. The invention as defined in claim 1 wherein the process is begun at the bottom of the well and each slug is jetted at a higher level than the preceding slug.

3. The invention as defined in claim 1 wherein the water is produced by an air lift pump.

4. The invention as defined in claim 1 wherein the air is jetted from structure circling the eduction tube.

5. The invention as defined in claim 1 wherein the air is jetted from a pressure of at least 75 atmosphere on the surface of the ground.

6. The invention as defined in claim 1 wherein the slug of air is sufficient to reduce the pressure in a tank of at least 0.3 cubic meters from 110 atmosphere to 90 atmosphere in at least 20 seconds.

7. The invention as defined in claim 1 wherein a slug of air having a volume of at least 0.5 cubic meters in the well is jetted.

8. The invention as defined in claim 1 wherein the slug of air has a rate of flow, at the point wherein it is jetted within the well, of at least 50 liters per second.

9. The invention as defined in claim 8 wherein the injection continues for at least 10 seconds.

10. The method of cleaning and rejuvenating an old water well having an eduction tube comprising: periodically jetting slugs of high velocity air from within the well outward in all horizontal direction, and while jetting air also continuously producing enough water from the bottom of the well by the eduction tube to remove all silt and debris therefrom.

11. The invention as defined in claim 10 wherein the process is begun at the bottom of the well and each slug is jetted at a higher level than the preceding slug.

12. The invention as defined in claim 10 wherein the water is produced by an air lift pump.

13. The invention as defined in claim 10 wherein the air is jetted from structure circling the eduction tube.

14. The invention as defined in claim 10 wherein the air is jetted from a pressure of at least 75 atmosphere on the surface of the ground.

15. The invention as defined in claim 10 wherein the slug of air is sufficient to reduce the pressure in a tank of at least 0.3 cubic meters from 110 atmosphere to 90 atmosphere in at least 20 seconds.

16. The invention as defined in claim 10 wherein a slug of air having a volume of at least 0.5 cubic meters in the well is jetted.

17. The invention as defined in claim 10 wherein the slug of air has a rate of flow, at the point wherein it is within the well, of at least 50 liters per second.

18. The invention as defined in claim 17 wherein the injection continues for at least 10 seconds.

19. In a water well having a. an eduction tube in b. a well bore, c. the improved structure comprising:

d. a jet ring adapted to surround the eduction tube within the well bore, c. said jet ring forming means for jetting air at high velocity in all horizontal directions, f. a source of high pressure air on the surface of the ground, and g. a conduit from the source of air to the jet ring.

20. The invention as defined in claim 19 with an additional limitation of h. said source of high pressure air being at pressures of at least 75 atmosphere.

21. The invention as defined in claim 19 with an additional limitation of h. said source of high pressure air having a volume of at least 0.3 cubic meters.

22. In a water well having a. an eduction tube in b. a well bore, c. THE IMPROVED STRUCTURE COMPRISING:

d. a jet ring adapted to surround the eduction tube within the well bore, e. said jet ring forming means for jetting air at high velocity in all horizontal directions, f. said jet ring having a gap circumscribing the jet ring through which high pressure air may be jetted, g. a source of high pressure air on the surface of the ground, and h. a conduit from the source of air to the jet ring.

23. The invention as defined in claim 22 with additional limitations of h. said jet ring is formed of i. a metering ring and ii. a plenum ring threaded to the metering ring, and j. said gap circumscribing the jet ring is between said metering and plenum rings.

24. The invention as defined in claim 23 with an additional limitation of k. said source of high pressure air being at pressures of at least 75 atmosphere.

25. The invention as defined in claim 24 with an additional limitation of m. said source of high pressure air having a volume of at least 0.3 cubic meters.

* * * * *